US012365964B2

(12) United States Patent
Marya

(10) Patent No.: US 12,365,964 B2
(45) Date of Patent: Jul. 22, 2025

(54) ALLOYS AND PROCESSES FOR MAKING AND USING SAME

(71) Applicant: Schlumberger Technology Corporation, Sugar Land, TX (US)

(72) Inventor: Manuel P. Marya, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 497 days.

(21) Appl. No.: 17/810,143

(22) Filed: Jun. 30, 2022

(65) Prior Publication Data

US 2022/0333223 A1 Oct. 20, 2022

Related U.S. Application Data

(62) Division of application No. 15/814,086, filed on Nov. 15, 2017, now abandoned.

(51) Int. Cl.
*C22C 12/00* (2006.01)
*E21B 33/13* (2006.01)

(52) U.S. Cl.
CPC ..... *C22C 12/00* (2013.01); *E21B 33/13* (2013.01)

(58) Field of Classification Search
CPC ..... C22C 12/00; C22C 13/00; C22C 13/02; E21B 33/13
See application file for complete search history.

(56) References Cited

U.S. PATENT DOCUMENTS 5,242,658 A 9/1993 Stevens et al.
6,384,389 B1 5/2002 Spencer
7,152,657 B2 12/2006 Bosma et al.
7,290,609 B2 11/2007 Wardlaw et al.
8,294,271 B2 10/2012 Lichtenberger
2004/0085178 A1* 5/2004 Tanaka ..... C22C 12/00 337/159
2006/0144591 A1 7/2006 Gonzalez et al.
2008/0047708 A1 2/2008 Spencer
2012/0055586 A1 3/2012 McIsaac et al.
2015/0368542 A1 12/2015 Carragher
2019/0144975 A1 5/2019 Marya

FOREIGN PATENT DOCUMENTS

KR 20030012963 A * 2/2003 ..... C23C 16/54

OTHER PUBLICATIONS

KR20030012963A (Year: 2003).*
Goodrich, W E., Volume changes during the solidification of metals and alloys of low melting-point, Transactions of the Faraday Society, yr: 1929 vol. 25 p. 531-569.
Glasbrenner H. et al., Expansion of solidified lead bismuth eutectic, Journal of nuclear materials, yr:2005 vol. 343 iss:1-3 p. 341-348.
Roth, Alexander, Vacuum Sealing Techniques, 1994, Table 3.4: From Vacuum Sealing Techniques, Chapter 3, p. 262, Springer, New York, NY, USA, 12 pgs.

* cited by examiner

*Primary Examiner* — Ricardo D Morales
(74) *Attorney, Agent, or Firm* — Jeffrey D. Frantz

(57) ABSTRACT

Alloys and processes for making and using same. In some examples, an alloy can include greater than 50 wt % to less than 65 wt % bismuth; greater than 35 wt % to less than 50 wt % tin; about 0.01 wt % to about 2.5 wt % indium; and at least one of: about 0.01 wt % to about 2.5 wt % antimony, about 0.01 wt % to about 0.5 wt % gallium, about 0.01 wt % to about 4 wt % zinc, and about 0.01 wt % to about 2.5 wt % chromium, with all weight percent values based on a total weight of the alloy. In other examples, an alloy can include greater than 50 wt % to less than 65 wt % bismuth; greater than 35 wt % to less than 50 wt % tin; about 0.01 wt % to about 2.5 wt % indium, and less than 1 wt % of lead, with all weight percent values based on a total weight of the alloy.

16 Claims, No Drawings

ALLOYS AND PROCESSES FOR MAKING AND USING SAME

This application is a divisional to U.S. patent application Ser. No. 15/814,086 filed Nov. 15, 2017, which is hereby incorporated by reference herein.

BACKGROUND

Field

Embodiments described generally relate to alloys and processes for making and using same. More particularly, such embodiments relate to fluid isolation alloys and processes for making and using same.

Description of the Related Art

Cement is an inexpensive and readily available material. Cement is often used in the completion and plugging of wells. Cement, however, is known to shrink as it sets. It also takes several hours to set, and can degrade over time, which makes cement less than ideal for use in the completion and plugging of wells. Additionally, cement lacks fluidity and, therefore, suffers from placement deficiencies, e.g., cement is unable to infiltrate small passageways, as often found in cracks of downhole tools and rock formations.

Various alloys, such as bismuth-tin, bismuth-tin-lead, and bismuth-tin-cadmium, have also been used in the completion and plugging of wells. Similar to cement, however these alloys also typically exhibit one or more undesirable properties for use in downhole environments, such as poor wetting properties, can be susceptible to corrosion, low latent heat of fusion and solidification (as related to resistance against solidification and flow for a proper placement), low hardness values (as related to creep resistance and the ability of the alloy to withstand stresses), and/or still exhibit insufficient fluidity when in the liquid state.

There is a need, therefore, for improved alloys for use in the completion and plugging of wells and other downhole operations. There is also a need for such alloys for remedial purposes and/or to supplement existing assets in need of repair or in need of a barrier against the environment; e.g., corrosion by well fluids or acidizing fluids such as hydrochloric acid.

SUMMARY

Alloys and processes for making and using same are provided. In some examples, an alloy can include greater than 50 wt % to less than 65 wt % bismuth; greater than 35 wt % to less than 50 wt % tin; about 0.01 wt % to about 2.5 wt % indium; and at least one of: about 0.01 wt % to about 2.5 wt % antimony, about 0.01 wt % to about 0.5 wt % gallium, about 0.01 wt % to about 4 wt % zinc, and about 0.01 wt % to about 2.5 wt % chromium, where all weight percent values are based on a total weight of the alloy.

In other examples, an alloy can include greater than 50 wt % to less than 65 wt % bismuth; greater than 35 wt % to less than 50 wt % tin; about 0.01 wt % to about 2.5 wt % indium, and less than 1 wt % of lead, where all weight percent values are based on a total weight of the alloy.

In some examples, a process for sealing a void in a downhole environment can include introducing an alloy into a wellbore. In one example, the alloy can include greater than 50 wt % to less than 65 wt % bismuth, greater than 35 wt % to less than 50 wt % tin, and about 0.01 wt % to about 2.5 wt % indium, where all weight percent values are based on a total weight of the alloy. In another example, the ally can include greater than 50 wt % to less than 65 wt % bismuth; greater than 35 wt % to less than 50 wt % tin; about 0.01 wt % to about 2.5 wt % indium, and less than 1 wt % of lead, where all weight percent values are based on a total weight of the alloy. The alloy can be melted to produce a liquid alloy. The liquid alloy can flow into a void. The liquid alloy can be solidified to produce a sealed void.

DETAILED DESCRIPTION

The alloy can be or include bismuth, tin, and indium. In some examples, in addition to bismuth, tin, and indium, the alloy can further include one or more additional metals. Suitable additional metals can include, but are not limited to, antimony, gallium, zinc, copper, nickel, chromium, or any mixture thereof.

In some examples, the alloy can be a eutectic composition, i.e., the alloy can have a single melting temperature. In other examples, the alloy can be a non-eutectic composition, i.e., the alloy can begin to melt at a first temperature (the solidus) and become completely liquid at a higher second temperature (the liquidus). In other examples, the alloy can be a near-eutectic composition. As used herein, the term "near-eutectic composition" refers to an alloy having an initial melting point (solidus) and a final melting point (liquidus) that are less than 5° C. away from one another. For example, a near-eutectic composition can have an initial melting point (solidus) of about 115° C. and a final melting point (liquidus) of about 120° C. or less.

The alloy can include greater than 50 wt %, about 53 wt %, about 55 wt %, or about 57 wt % to less than 65 wt %, about 63 wt %, about 61 wt %, or about 59 wt % of bismuth, based on a total weight of the alloy. The alloy can include greater than 35 wt %, about 37 wt %, about 39 wt %, or about 41 wt % to less than 50 wt %, about 48 wt %, about 46 wt %, about 44 wt %, or about 42 wt % of tin, based on the total weight of the alloy. The alloy can include about 0.01 wt %, about 0.05 wt %, about 0.1 wt %, about 0.3 wt %, about 0.5 wt %, or about 1 wt % to about 1.3 wt %, about 1.5 wt %, about 1.7 wt %, about 2 wt %, about 2.3 wt %, about 2.5 wt %, about 2.7 wt %, or about 3 wt % of indium, based on the total weight of the alloy. In some examples, the alloy can include less than 3 wt %, less than 2.7 wt %, less than 2.5 wt %, less than 2.3 wt %, less than 2 wt %, less than 1.9 wt %, less than 1.7 wt %, less than 1.5 wt %, less than 1.3 wt %, or less than 1 wt % of indium, based on the total weight of the alloy. In some examples, the alloy can include greater than 50 wt % to less than 65 wt % of bismuth, greater than 35 wt % to less than 50 wt % of tin, and about 0.1 wt % to about 2.5 wt % of indium, based on the total weight of the alloy. In other examples, the alloy can include about 53 wt % to about 57 wt % of bismuth, about 37 wt % to about 43 wt % of tin, and about 0.1 wt % to about 2.5 wt % of indium, based on the total weight of the alloy. In some examples, the alloy can include a combined amount of the bismuth and tin of at least 90 wt %, at least 91 wt %, at least 92 wt %, at least 93 wt %, at least 94 wt %, at least 95 wt %, at least 96 wt %, at least 97 wt %, at least 98 wt %, or at least 99 wt %, based on the total weight of the alloy.

In some examples, the alloy can include greater than 50 wt % to less than 65 wt % of bismuth, greater than 35 wt % to less than 50 wt % of tin, about 0.01 wt % to about 2.5 wt % of indium, and about 0.01 wt %, about 0.05 wt %, about 0.1 wt %, about 0.3 wt %, about 0.5 wt %, or about 0.7 wt % to about 1 wt %, about 1.3 wt %, about 1.5 wt %, about 1.7 wt %, about 2 wt %, about 2.3 wt %, about 2.5 wt %, about 2.7 wt %, or about 3 wt % of antimony, based on a total weight of the alloy. In some examples, the alloy can include greater than 50 wt % to less than 65 wt % of bismuth, greater than 35 wt % to less than 50 wt % of tin, about 0.01 wt % to about 2.5 wt % of indium, and about 0.01 wt %, about 0.05 wt %, about 0.07 wt %, about 0.1 wt %, about 0.15 wt %, or about 0.2 wt % to about 0.3 wt %, about 0.35 wt %, about 0.4 wt %, about 0.45 wt %, or about 0.5 wt % of gallium, based on a total weight of the alloy. In some examples, the alloy can include greater than 50 wt % to less than 65 wt % of bismuth, greater than 35 wt % to less than 50 wt % of tin, about 0.01 wt % to about 2.5 wt % of indium, and about 0.01 wt %, about 0.05 wt %, about 0.1 wt %, about 0.3 wt %, about 0.5 wt %, about 0.7 wt %, about 1 wt %, about 1.3 wt %, or about 1.5 wt % to about 2 wt %, about 2.3 wt %, about 2.5 wt %, about 2.7 wt %, about 3 wt %, about 3.3 wt %, about 3.5 wt %, about 3.7 wt %, or about 4 wt % of zinc, based on a total weight of the alloy. In some examples, the alloy can include greater than 50 wt % to less than 65 wt % of bismuth, greater than 35 wt % to less than 50 wt % of tin, about 0.01 wt % to about 2.5 wt % of indium, and about 0.01 wt %, about 0.05 wt %, about 0.1 wt %, about 0.3 wt %, about 0.5 wt %, about 0.7 wt %, or about 1 wt % to about 1.5 wt %, about 1.7 wt %, about 2 wt %, about 2.3 wt %, about 2.5 wt %, about 2.7 wt %, or about 3 wt % of copper, based on a total weight of the alloy. In some examples, the alloy can include greater than 50 wt % to less than 65 wt % of bismuth, greater than 35 wt % to less than 50 wt % of tin, about 0.01 wt % to about 2.5 wt % of indium, and about 0.01 wt %, about 0.05 wt %, about 0.07 wt %, about 0.1 wt %, about 0.15 wt %, about 0.2 wt %, about 0.3 wt %, or about 0.4 wt % to about 0.5 wt %, about 0.6 wt %, about 0.7 wt %, about 0.8 wt %, about 0.9 wt %, or about 1 wt % of nickel, based on a total weight of the alloy. In some examples, the alloy can include greater than 50 wt % to less than 65 wt % of bismuth, greater than 35 wt % to less than 50 wt % of tin, about 0.01 wt % to about 2.5 wt % of indium, and about 0.01 wt %, about 0.05 wt %, about 0.1 wt %, about 0.3 wt %, about 0.5 wt %, or about 0.7 wt % to about 1 wt %, about 1.3 wt %, about 1.5 wt %, about 1.7 wt %, about 2 wt %, about 2.3 wt %, or about 2.5 wt % of chromium, based on a total weight of the alloy.

In some examples, the alloy can include greater than 50 wt % to less than 65 wt % of bismuth, greater than 35 wt % to less than 50 wt % of tin, about 0.01 wt % to about 2.5 wt % of indium, and at least one, at least two, at least three, or at least four of: about 0.01 wt % to about 2.5 wt % of antimony, about 0.01 wt % to about 0.5 wt % of gallium, about 0.01 wt % to about 4 wt % of zinc, and about 0.01 wt % to about 2.5 wt % of chromium, based on the total weight of the alloy. In another example, the alloy can include greater than 50 wt % to less than 65 wt % of bismuth, greater than 35 wt % to less than 50 wt % of tin, about 0.01 wt % to about 2.5 wt % of indium, about 0.1 wt % to about 0.5 wt % of gallium, about 0.1 wt % to about 4 wt % of zinc, and about 0.1 wt % to about 2.5 wt % of chromium, based on the total weight of the alloy. In another example, the alloy can include greater than 50 wt % to less than 65 wt % of bismuth, greater than 35 wt % to less than 50 wt % of tin, about 0.01 wt % to about 2.5 wt % of indium, about 0.1 wt % to about 2.5 wt % of antimony, and about 0.1 wt % to about 2.5 wt % of chromium, based on the total weight of the alloy. In another example, the alloy can include greater than 50 wt % to less than 65 wt % of bismuth, greater than 35 wt % to less than 50 wt % of tin, about 0.01 wt % to about 2.5 wt % of indium, about 0.1 wt % to about 2.5 wt % of antimony, and about 0.1 wt % to about 4 wt % of zinc, based on the total weight of the alloy. In another example, the alloy can include greater than 50 wt % to less than 65 wt % of bismuth, greater than 35 wt % to less than 50 wt % of tin, about 0.01 wt % to about 2.5 wt % of indium, about 0.1 wt % to about 2.5 wt % of antimony, and about 0.1 wt % to about 0.5 wt % of gallium, based on the total weight of the alloy. In another example, the alloy can include greater than 50 wt % to less than 65 wt % of bismuth, greater than 35 wt % to less than 50 wt % of tin, about 0.01 wt % to about 2.5 wt % of indium, about 0.1 wt % to about 2.5 wt % of antimony, and about 0.1 wt % to about 4 wt % of zinc, and about 0.1 wt % to about 3 wt % of copper, based on the total weight of the alloy.

In some examples, if the alloy includes bismuth, tin, indium, and one or more of antimony, gallium, zinc, and chromium, the alloy can include about 0.1 wt %, about 0.3 wt %, about 0.5 wt %, about 0.7 wt %, about 1 wt %, about 1.3 wt %, about 1.5 wt %, about 1.7 wt %, or about 2 wt % to about 3 wt %, about 4 wt %, about 5 wt %, about 6 wt %, about 6.5 wt %, about 7 wt %, about 8 wt %, about 9 wt %, or about 10 wt % of a combined amount of any antimony, any gallium, any zinc, and any chromium, based on the total weight of the alloy. In other examples, if the alloy includes bismuth, tin, indium, and one or more of antimony, gallium, zinc, and chromium, the alloy can include less than 10 wt %, less than 9.5 wt %, less than 9 wt %, less than 8.5 wt %, less than 8 wt %, less than 7.5 wt %, less than 7 wt %, less than 6.5 wt %, less than 6 wt %, less than 5.5 wt %, less than 5 wt %, less than 4.5 wt %, less than 4 wt %, less than 3.5 wt %, or less than 3 wt % of a combined amount of any antimony, any gallium, any zinc, and any chromium, based on the total weight of the alloy.

In some examples, if the alloy includes bismuth, tin, indium, and one or more of antimony, gallium, zinc, chromium, copper, and nickel, the alloy can include about 0.1 wt %, about 0.3 wt %, about 0.5 wt %, about 0.7 wt %, about 1 wt %, about 1.3 wt %, about 1.5 wt %, about 1.7 wt %, or about 2 wt % to about 3 wt %, about 4 wt %, about 5 wt %, about 6 wt %, about 7 wt %, about 8 wt %, about 9 wt %, or about 10 wt % of a combined amount of any antimony, any gallium, any zinc, any chromium, any copper, and any nickel, based on the total weight of the alloy. In other examples, if the alloy includes bismuth, tin, indium, and one or more of antimony, gallium, zinc, chromium, copper, and nickel, the alloy can include about 1.5 wt % to about 6 wt %, about 1.75 wt % to about 5 wt %, about 2 wt % to about 4.5 wt %, about 3 wt % to about 4 wt %, about 2.5 wt % to about 4.5 wt %, or about 3.5 wt % to about 6 wt % of a combined amount of any antimony, any gallium, any zinc, any chromium, any copper, and any nickel, based on the total weight of the alloy.

In some examples, the alloy can be substantially free or free of any lead. For example, the alloy can include less than 1 wt %, less than 0.7 wt %, less than 0.5 wt %, less than 0.3 wt %, less than 0.1 wt %, or less than 0.01 wt % of lead, based on the total weight of the alloy. In some examples, the alloy can be substantially free or free of any cadmium. For example, the alloy can include less than 1 wt %, less than 0.7 wt %, less than 0.5 wt %, less than 0.3 wt %, less than 0.1 wt %, or less than 0.01 wt % of cadmium, based on the total weight of the alloy. In some examples, the alloy can be substantially free of or free of any lead and any cadmium. For example, the alloy can include less than 1 wt %, less than 0.7 wt %, less than 0.5 wt %, less than 0.3 wt %, less than 0.1 wt %, or less than 0.01 wt % of a combined amount of any lead and any cadmium, based on the total weight of the alloy. In some examples, the alloy can be substantially free or free of any aluminum. For example, the alloy can include less than 1 wt %, less than 0.7 wt %, less than 0.5 wt %, less than 0.3 wt %, less than 0.1 wt %, or less than 0.01 wt % of aluminum, based on the total weight of the alloy. In some examples, the alloy can be substantially free or free of any magnesium. For example, the alloy can include less than 1 wt %, less than 0.7 wt %, less than 0.5 wt %, less than 0.3 wt %, less than 0.1 wt %, or less than 0.01 wt % of magnesium, based on the total weight of the alloy. In some examples, the alloy can be substantially free or free of any actinide element. For example, the alloy can include less than 1 wt %, less than 0.7 wt %, less than 0.5 wt %, less than 0.3 wt %, less than 0.1 wt %, or less than 0.01 wt % of actinide elements, based on the total weight of the alloy. In some examples, the alloy can be substantially free or free of any lanthanide element. For example, the alloy can include less than 1 wt %, less than 0.7 wt %, less than 0.5 wt %, less than 0.3 wt %, less than 0.1 wt %, or less than 0.01 wt % of lanthanide elements, based on the total weight of the alloy. In some examples, the alloy can include less than 1 wt %, less than 0.7 wt %, less than 0.5 wt %, less than 0.3 wt %, less than 0.1 wt %, or less than 0.01 wt % of a combined amount of lead, cadmium, aluminum, magnesium, actinide elements, and lanthanide elements, based on the total weight of the alloy.

The alloy can have a melting point of about 115° C., about 116° C., about 117° C., about 118° C., about 119° C., about 120° C., about 121° C., about 122° C., about 123° C., about 124° C., or about 125° C. to about 127° C., about 128° C., about 129° C., about 130° C., about 131° C., about 132° C., about 133° C., about 134° C., about 135° C., about 136° C., or about 137° C. In some examples, the alloy can have a melting point of less than 137° C., less than 135° C., less than 133° C., less than 131° C., less than 130° C., less than 129° C., less than 128° C., or less than 127° C. In some examples, the alloy can have a melting point of about 115 to about 125° C., about 115° C. to about 122° C., about 115° C. to about 120° C., about 122° C. to about 127° C., or about 116° C. to about 126° C. The melting point of the alloy can be measured via differential scanning calorimetry (DSC) according to ASTM E794-06(2012). When the alloy is melted, i.e., liquid, the alloy can expand as the alloy freezes, i.e., solidifies. In some examples, a volume of the melted alloy can expand by at least 0.5% as the alloy freezes.

The alloy can have an enthalpy of fusion or a latent heat of fusion of about 40 J/g, about 41 J/g, about 42 J/g, about 43 J/g, about 44 J/g, or about 45 J/g to about 46 J/g, about 47 J/g, about 48 J/g, about 49 J/g, about 50 J/g, about 51 J/g, or more. In some examples, the alloy can have a latent heat of fusion of at least 44 J/g, at least 45 J/g, at least 46 J/g, at least 47 J/g, at least 48 J/g, at least 49 J/g, or at least 50 J/g. The latent heat of fusion can be measured via differential scanning calorimetry according to ASTM E793-06(2012).

The alloy can have an average Vickers Hardness number (HVN) of about 16.5, about 17, about 17.5, about 18, about 18.5, about 19 or about 19.5 to about 20, about 20.5, about 21, about 21.5, about 22, about 22.5, about 23, about 23.5, or about 24, as measured according to ASTM E384-17 using a 50 g indentation load applied for 60 seconds. In determining the average Vickers Hardness number at least 2 samples can be measured and the average calculated therefrom.

The alloy can be resistant to corrosion. The corrosion resistance can be measured according to a modified ASTM G-4 and NACE TM01769 procedure. Test samples can be extracted from a cast sample, ground, and polished (up to 600 grit paper) into test cubes having sides of about 10 mm in length. For the corrosion test, a 28% hydrochloric acid (HCl) solution can be prepared from concentrated HCl and water. The test samples can be exposed for 6 hrs to the 28% HCl at a temperature of about 25° C. The weight of each sample can be recorded before and after the tests as per the recommendations of ASTM G-4 and NACE TM01769. The weight loss can be reported in terms of the percent of the weight of the tested samples decreased rather than in mils per year as normally recommended by the standards. In some examples, a weight of an alloy sample can decrease by less than 20 wt %, less than 17 wt %, less than 15 wt %, less than 13 wt %, less than 10 wt %, less than 7 wt %, less than 5 wt %, less than 3 wt %, less than 2 wt %, less than 1.5 wt %, less than 1 wt %, or less than 0.7 wt % per day when the alloy sample is in contact with a 28% hydrochloric acid solution at a temperature of about 25° C. The decrease in weight percent values per day can be derived by multiplying the values measured at 6 hours by 4.

The alloy can have an average wetting angle on mica of about 137°, about 139°, about 141°, about 143°, or about 145° to about 147°, about 149°, about 151°, about 153°, about 155°, or about 157°. In some examples, the alloy can have an average wetting angle on mica of less than 150°, less than 149°, less than 148°, less than 147°, less than 146°, less than 145°, less than 144°, less than 143°, less than 142°, less than 141°, or less than 140°. The mica can be fluorphlogopite mica in a borosilicate matrix. A suitable mica can include MACOR® that is available from Corning. This ceramic material is inert, thermally stable, has a controlled composition, is machinable, and, therefore, procurable as flat pieces (unlike natural mica). The test plate can be about 38.7 $cm^2$ and about 15.24 cm thick and white in color.

The alloy can have an average wetting angle on silicate of about 133°, about 135°, about 137°, or about 139° to about 141°, about 143°, about 145°, about 147°, about 149°, or about 151°. In some examples, the alloy can have an average wetting angle on silicate of less than 142°, less than 141°, less than 140°, less than 139°, less than 138°, or less than 137°. The silicate can be a grey alumina-silicate plate rated up to a temperature of about 1,099° C. (about 2010° F.). The test plate can be 38.7 $cm^2$ and about 15.24 cm thick.

The alloy can have an average wetting angle on carbon steel of about 132°, about 134°, about 136°, about 138°, or about 140° to about 142°, about 144°, about 146°, about 148°, about 150°, or about 152°. In some examples, the alloy can have an average wetting angle on carbon steel of less than 143°, less than 142°, less than 141°, less than 140°, less than 139°, less than 138°, or less than 137°. The steel can be a carbon steel substrate made of a 1020 carbon steel panel. The 1020 carbon steel, as procured from third-party, was degreased in alkali solution (soap) and immediately dried to prevent corrosion.

The alloy can have an average wetting angle on rusted steel of about 130°, about 132°, about 134°, about 136°, about 138, or about 140° to about 142°, about 144°, about 146°, about 148°, about 150°, or about 152°. In some examples, the alloy can have an average wetting angle on rusted steel of less than 145°, less than 144°, less than 143°, less than 142°, less than 141°, less than 140°, or less than 139°. The rusted steel can be made by preconditioning a 1020 carbon steel panel with a salt spray. The resulting rusted steel can have a thick, reddish and uniform oxide layer thereon.

The average wetting angles on mica, silicate, carbon steel, and rusted steel can be measured by pre-positioning about 2 g to about 5 g of the alloy onto the substrate, i.e., mica, silicate, carbon steel, or rusted steel, melting the alloy in an oven at a temperature of about 200° C., and slowly re-solidifying the alloy in the oven by cooling the alloy at a rate of about 1° C. per minute to about 10° C. per minute, e.g., about 5° C. per minute. The measured average wetting angles can be the contact angle at freezing of the alloy. The average wetting angles can be measured via high-magnification images of the frozen alloy droplet profiles. At least six (6) wetting angles can be measured per droplet and two (2) droplets per alloy can be measured. Accordingly, the average wetting angle of the alloy can be an average of at least twelve (12) measurements. The procedure used to measure the wetting angles can be according to ASTM D7334-08 (2013).

The alloy can be prepared via any suitable process. For example, metal powders, granules, filings, ingots, shot, flakes, shavings, or any other form of each metal component can be added to a suitable vessel, e.g., a crucible. The metals can be melted together using any desired melting technique. In one example, the vessel containing the metals can be heated in an oven to a temperature at which the material is a liquid and allowed to cool to provide a solid alloy. In some examples, the liquid can be stirred prior to cooling. The alloy can be fabricated into a desired shape, such as a rod, wire, foil, ingots, or the like. The metals can be heated in any desired atmosphere, e.g., air.

The alloy can be used in a number of applications. In one example, the alloy can be used to seal a cavity, opening, crack, crevice, channel, groove, bore, or any other void. In a downhole environment, illustrative voids can include, but are not limited to, the wellbore; cracks, perforations, or other openings in a casing, tube, pipe, or other conduit; voids located within a subterranean formation; fluid passage ways within downhole tools, e.g., ports in sand screens and downhole chokes and valves; and any other void that may be desired to seal either permanently or temporarily. As such, the alloy can be used in a process for in-situ casting of well equipment. For example, the alloy can be used as a well abandonment plug; an annular seal plug, e.g., an annular cavity between a pair of co-axial well tubulars can be sealed with the alloy; a temporary reversible plug; an external shut-off medium; a repair medium; and/or an alternate packer or liner hanger seal. Illustrative in-situ casting well equipment and processes for making same can include those discussed and described in U.S. Pat. No. 7,152,657.

The alloy can be introduced to the void or adjacent the void in a solid state, in a liquid state, or in a mixed state, i.e., as both a solid and a liquid. If in the solid state, the alloy can be heated sufficiently to melt the alloy and the alloy can fill the void. Upon melting, the heat can be removed and the alloy can cool to produce a solid alloy that occupies the void. As noted above, the alloy can expand as the liquid alloy transitions to the solid alloy. As such, the alloy can provide a tight seal that can be resistant to coming out of the void. Should one desire to reopen a sealed void one can heat the alloy within the void and allow the melted alloy to flow out and away from the void. Numerous apparatus for supplying a sufficient amount of heat to melt the alloy downhole are well-known and readily available. For example, the apparatus and processes discussed and described in U.S. Pat. Nos. 6,384,389 and 7,290,609 and U.S. Patent Application Publication Nos. 2006/0144591; 2008/0047708; and 2015/0368542 can be used to melt the alloy in a downhole environment.

In another example, the alloy can be used to coat a wire, a cable, a hose, or other elongated element. Illustrative elongated elements can include, but are not limited to, electrical wires or cables, fiber optic cables, pneumatic hoses, or the like. An electric submersible pump cable can be used as one example. Electric submersible pump cables generally include three copper conductors cabled together, with each conductor including a layer of polymeric insulation and an optional semi-conductive layer disposed thereabout. A filler material can fill interstitial spaces between the cabled conductors and a polymeric jacket can be extruded over the cabled conductors to produce a jacketed core. An outer metal layer can be applied about the jacketed core and seam welded to provide an outer metal layer that increases the strength of the cable and provides protection to the jacketed core. The alloy can be used to provide the outer metal layer. In some cases, due, at least in part, to the relatively low melting temperature of the alloy, it is believed that the alloy can be melted and the jacketed core can be coated with the melted alloy. In other examples, the alloy can be applied to the jacketed core in the solid state and seam welded thereabout. The alloy can exhibit excellent corrosion resistance and can provide a barrier between the jacketed core and an external environment, e.g., a downhole environment.

In another example, the alloy can be used as a coating for a body, e.g., a metal body. For example, the alloy can be used to coat steel, galvanized metal, or other metal bodies. In another example, the alloy can be used to coat any field part, e.g., downhole tools, downhole pipes or conduits, surface equipment, or the like. In some examples, the alloy can be coated onto a surface of a body and can provide an anti-galling coating. For example, the alloy can form, serve, or otherwise function as a solid lubricant. In another example the alloy can be formed into threads. In another example, the alloy can be used to form a seal between metal and ceramic surfaces, metal and metal surfaces, and/or ceramic and ceramic surfaces.

EXAMPLES

In order to provide a better understanding of the foregoing discussion, the following non-limiting examples are offered. Although the examples may be directed to specific embodiments, it is not to be viewed as limiting the invention in any specific respect. All parts, proportions, and percentages are by weight unless otherwise indicated.

Comparative Examples C1-C3 and inventive examples Exs. 1-12 were prepared and properties were measured. For each alloy, a sample of about 150 grams was prepared placing the appropriate amount of each metal component into a crucible and heating the crucible in a furnace to a temperature of about 480° C. in air for about 10 minutes. The composition of each alloy and the measured properties of each alloy are shown in Tables 1 and 3, respectively, below.

TABLE 1

| | Alloy Compositions (wt %) | | | | | | | | |
|---|---|---|---|---|---|---|---|---|---|
| | Bi | Sn | In | Sb | Ga | Zn | Cr | Cu | Ni |
| C1 | 57.00 | 43.00 | | | | | | | |
| C2 | 56.00 | 42.00 | | 2.00 | | | | | |
| C3 | 56.00 | 40.00 | | | | 4.00 | | | |
| Ex. 1 | 56.00 | 42.00 | 2.00 | | | | | | |
| Ex. 2 | 55.00 | 41.00 | 2.00 | 2.00 | | | | | |
| Ex. 3 | 54.75 | 40.75 | 2.00 | 2.00 | 0.50 | | | | |
| Ex. 4 | 55.00 | 39.00 | 2.00 | | | 4.00 | | | |
| Ex. 5 | 54.00 | 38.00 | 2.00 | 1.00 | | 4.00 | | | |
| Ex. 6 | 54.50 | 40.00 | 2.00 | 2.00 | 0.50 | 1.00 | | | |
| Ex. 7 | 54.50 | 38.50 | 2.50 | 2.50 | 0.50 | 1.00 | 0.50 | | |

TABLE 1-continued

| Alloy Compositions (wt %) | | | | | | | | | |
|---|---|---|---|---|---|---|---|---|---|
| | Bi | Sn | In | Sb | Ga | Zn | Cr | Cu | Ni |
| Ex. 8 | 56.00 | 40.00 | 2.25 | | 0.25 | 1.00 | 0.50 | | |
| Ex. 9 | 56.00 | 40.00 | 2.00 | | 0.25 | 1.00 | 0.75 | | |
| Ex. 10 | 54.75 | 39.75 | 1.50 | 1.50 | | | 2.50 | | |
| Ex. 11 | 54.75 | 40.75 | 2.00 | 2.00 | | | 0.50 | | |
| Ex. 12 | 54.75 | 39.25 | 1.50 | 1.50 | | 2.00 | | 1.00 | |
| Ex. 13 | 54.50 | 40.50 | 1.75 | 2.25 | 0.25 | | 0.50 | | 0.25 |
| Ex. 14 | 54.50 | 39.00 | 1.75 | 1.75 | | | 0.50 | 2.00 | 0.50 |
| Ex. 15 | 54.00 | 38.00 | 1.75 | 1.50 | | | 0.75 | 3.00 | 1.00 |

TABLE 2

| Properties of the Alloys | | | | | | | | |
|---|---|---|---|---|---|---|---|---|
| | Melting Point (° C.) | Latent Heat (J/g) | HVN (50 g/ 60 sec) | Wetting Angle vs. Mica (°) | Wetting Angle vs. Silicate (°) | Wetting Angle vs. Steel (°) | Wetting Angle vs. Rusted Steel (°) | HCl Acid (%/day) |
| C1 | 135.0 | 44.0 | 18.9 | 153.7 | 144.3 | 143.2 | 149.8 | 11.5 |
| C2 | 137.0 | 45.0 | 20.1 | 155.1 | 144.6 | 143.1 | 147.5 | 0.7 |
| C3 | 133.0 | 49.0 | 19.8 | 154.6 | 142.3 | 146.2 | 146.8 | 25.0 |
| Ex. 1 | 124.0 | 44.0 | 17.6 | 156.0 | 144.9 | 143.0 | 144.8 | 0.7 |
| Ex. 2 | 127.9 | 44.0 | 22.9 | 146.9 | 139.2 | 135.7 | 132.8 | 20.4 |
| Ex. 3 | 124.0 | 43.0 | 21.4 | 149.6 | 143.4 | 144.3 | 151.5 | 19.9 |
| Ex. 4 | 118.0 | 45.0 | 15.6 | 151.7 | 147.2 | 148.1 | 142.6 | 5.6 |
| Ex. 5 | 116.0 | 44.0 | 19.1 | 153.2 | 150.1 | 150.4 | 145.3 | 19.7 |
| Ex. 6 | 126.0 | 47.0 | 22.8 | 142.4 | 141.5 | 139.2 | 144.9 | 11.5 |
| Ex. 7 | 126.0 | 43.0 | 18.3 | 140.8 | 137.5 | 145.2 | 139.9 | 13.1 |
| Ex. 8 | 126.0 | 48.5 | 17.3 | 142.7 | 138.1 | 134.6 | 144.4 | 1.1 |
| Ex. 9 | 126.0 | 50.0 | 18.4 | 139.5 | 135.2 | 138.2 | 138.6 | 0.5 |
| Ex. 10 | 125.0 | 50.1 | 16.9 | — | — | — | — | — |
| Ex. 11 | 129.0 | 50.2 | 18.0 | — | — | — | — | — |
| Ex. 12 | 126.0 | 48.1 | 17.0 | — | — | — | — | — |
| Ex. 13 | 129.0 | 46.9 | 16.5 | — | — | — | — | — |
| Ex. 14 | 132.0 | 46.0 | 27.7 | — | — | — | — | — |
| Ex. 15 | 129.0 | 43.4 | 30.4 | — | — | — | — | — |

The melting point values and the latent heat values were measured simultaneously via differential scanning calorimetry (DSC) according to ASTM E794-06(2012) and ASTM E793-06(2012), respectively, and represent the average value from two (2) measured samples. The HVN values represent the average value from at least six (6) measured samples that were measured according to ASTM E384-17 with a 50 gram indentation load applied for 60 seconds. The wetting angles were measured following extraction of about 2 g to about 5 g of the alloy that were pre-positioned onto the selected substrate, re-melted in an oven at a temperature of about 200° C., and slowly re-solidified in the oven while cooled. The reported wetting angles are representative of the contact angle at freezing of the alloy. The wetting angles were measured via high-magnification images of the formed metal droplet profiles. At least six (6) wetting angles were measured per droplet and two (2) droplets per alloy were measured. Accordingly, the reported wetting angles are an average of at least twelve (12) measurements, measured according to ASTM D7334-08 (2013). The mica was fluorphlogopite mica in a borosilicate matrix (MACOR®), acquired form from Corning. The silicate was a grey alumina-silicate plate rated up to a temperature of about 1,099° C. (about 2010° F.). The steel was a carbon steel substrate made of a 1020 carbon steel panel. The rusted steel was a 1020 carbon steel panel that had been pre-conditioned with a salt spray and had a thick, reddish and uniform oxide layer thereon. To measure the HCl Acid values, samples were exposed for 6 hrs to a 28% hydrochloric acid solution at a temperature of about 25° C. The weight of each sample was recorded before and after the tests as per the recommendations of ASTM G-4 and NACE TM01769. The weight lost was multiplied by 4 to arrive at the %/day values.

Embodiments of the present disclosure further relate to any one or more of the following paragraphs:

1. An alloy, comprising: greater than 50 wt % to less than 65 wt % bismuth; greater than 35 wt % to less than 50 wt % tin; about 0.01 wt % to about 2.5 wt % indium; and at least one of: about 0.01 wt % to about 2.5 wt % antimony, about 0.01 wt % to about 0.5 wt % gallium, about 0.01 wt % to about 4 wt % zinc, and about 0.01 wt % to about 2.5 wt % chromium, wherein all weight percent values are based on a total weight of the alloy.

2. A process for sealing a void in a downhole environment, comprising: introducing an alloy into a wellbore, wherein the alloy comprises greater than 50 wt % to less than 65 wt % bismuth, greater than 35 wt % to less than 50 wt % tin, and about 0.01 wt % to about 2.5 wt % indium, and wherein all weight percent values are based on a total weight of the alloy; melting the alloy to produce a liquid alloy; flowing the liquid alloy into a void; and solidifying the liquid alloy to produce a sealed void.

3. The alloy or process according to paragraph 1 or 2, further comprising at least one of: about 0.01 wt % to about 3 wt % copper, and about 0.01 wt % to about 1 wt % nickel, based on the total weight of the alloy.

4. The alloy or process according to any one of paragraphs 1 to 3, wherein the alloy comprises less than 10 wt % of a combined amount of antimony, gallium, zinc, and chromium, based on the total weight of the alloy.

5. The alloy or process according to any one of paragraphs 1 to 4, wherein the alloy comprises about 1.5 wt % to about 6.5 wt % of a combined amount of antimony, gallium, zinc, and chromium, based on the total weight of the alloy.

6. The alloy or process according to any one of paragraphs 1 to 5, wherein the alloy comprises at least 90 wt % of a combined amount of bismuth and tin, based on the total weight of the alloy.

7. The alloy or process according to any one of paragraphs 1 to 6, wherein the alloy has an average wetting angle on mica of less than 150°, as measured according to ASTM D7334-08 (2013).

8. The alloy or process according to any one of paragraphs 1 to 7, wherein the alloy has an average wetting angle on silicate of less than 142°, as measured according to ASTM D7334-08 (2013).

9. The alloy or process according to any one of paragraphs 1 to 8, wherein the alloy has an average wetting angle on mica of less than 143°, as measured according to ASTM D7334-08 (2013).

10. The alloy or process according to any one of paragraphs 1 to 9, wherein the alloy has an average wetting angle on silicate of less than 139°, as measured according to ASTM D7334-08 (2013).

11. The alloy or process according to any one of paragraphs 1 to 10, wherein the alloy comprises about 0.1 wt % to about 0.5 wt % gallium, about 0.1 wt % to about 2 wt % zinc, and about 0.1 wt % to about 1.5 wt % chromium, based on the total weight of the alloy.

12. The alloy or process according to any one of paragraphs 1 to 10, wherein the alloy comprises about 0.1 wt % to about 2.5 wt % antimony, about 0.1 wt % to about 0.5 wt % gallium, about 0.1 wt % to about 4 wt % zinc, and about 0.1 wt % to about 2.5 wt % chromium, based on the total weight of the alloy.

13. The alloy or process according to any one of paragraphs 1 to 10, wherein the alloy comprises about 0.1 wt % to about 2.5 wt % antimony and about 0.1 wt % to about 2.5 wt % chromium, based on the total weight of the alloy.

14. The alloy or process according to any one of paragraphs 1 to 13, wherein the alloy has a melting point of about 115° C. to about 137° C., as measured according to ASTM E794-06(2012).

15. The alloy or process according to any one of paragraphs 1 to 13, wherein the alloy has a melting point of about 115° C. to about 130° C., as measured according to ASTM E794-06(2012).

16. The alloy or process according to any one of paragraphs 1 to 13, wherein the alloy has a melting point of about 115° C. to about 127° C., as measured according to ASTM E794-06(2012).

17. The alloy or process according to any one of paragraphs 1 to 113, wherein the alloy has a melting point of about 115° C. to less than 137° C., as measured according to ASTM E794-06(2012).

18. The alloy or process according to any one of paragraphs 1 to 13, wherein the alloy has a melting point of about 115° C. to less than 127° C., as measured according to ASTM E794-06(2012).

19. The alloy or process according to any one of paragraphs 1 to 18, wherein the alloy has a Vickers Hardness number of greater than 16, as measured according to ASTM E384-17 with a 50 gram indentation load applied for 60 seconds.

20. The alloy or process according to any one of paragraphs 1 to 18, wherein the alloy has a Vickers hardness number of greater than 20, as measured according to ASTM E384-17 with a 50 gram indentation load applied for 60 seconds.

21. The alloy or process according to any one of paragraphs 1 to 18, wherein the alloy has a Vickers hardness number of greater than 16 to about 32, as measured according to ASTM E384-17 with a 50 gram indentation load applied for 60 seconds.

22. The alloy or process according to any one of paragraphs 1 to 18, wherein the alloy has a Vickers hardness number of greater than 20.5 to about 32, as measured according to ASTM E384-17 with a 50 gram indentation load applied for 60 seconds.

23. The alloy or process according to any one of paragraphs 1 to 18, wherein the alloy has a Vickers hardness number of greater than 21 to about 32, as measured according to ASTM E384-17 with a 50 gram indentation load applied for 60 seconds.

24. The alloy or process according to any one of paragraphs 1 to 23, wherein the alloy has a latent heat of fusion of greater than 45 J/g, as measured according to ASTM E793-06(2012).

25. The alloy or process according to any one of paragraphs 1 to 23, wherein the alloy has a latent heat of fusion of about 42 J/g to about 55 J/g, as measured according to ASTM E793-06(2012).

26. The alloy or process according to any one of paragraphs 1 to 23, wherein the alloy has a latent heat of fusion of greater than 47 J/g to about 55 J/g, as measured according to ASTM E793-06(2012).

27. The alloy or process according to any one of paragraphs 1 to 23, wherein the alloy has a latent heat of fusion of greater than 43 J/g to about 55 J/g, as measured according to ASTM E793-06(2012).

28. The alloy or process according to any one of paragraphs 1 to 23, wherein the alloy has a latent heat of fusion of greater than 45 J/g to about 55 J/g, as measured according to ASTM E793-06(2012).

29. The alloy or process according to any one of paragraphs 1 to 28, wherein a weight of an alloy sample decreases by less than 20 wt % per day when the alloy sample is in contact with a 28% hydrochloric acid solution at a temperature of about 25° C.

30. The alloy or process according to any one of paragraphs 1 to 28, wherein a weight of an alloy sample decreases by less than 10 wt % per day when the alloy sample is in contact with a 28% hydrochloric acid solution at a temperature of about 25° C.

31. The alloy or process according to any one of paragraphs 1 to 28, wherein a weight of an alloy sample decreases by less than 5 wt % per day when the alloy sample is in contact with a 28% hydrochloric acid solution at a temperature of about 25° C.

32. The alloy or process according to any one of paragraphs 1 to 28, wherein a weight of an alloy sample decreases by less than 1.5 wt % per day when the alloy sample is in contact with a 28% hydrochloric acid solution at a temperature of about 25° C.

33. The alloy or process according to any one of paragraphs 1 to 28, wherein a weight of an alloy sample decreases by less than 1 wt % per day when the alloy sample is in contact with a 28% hydrochloric acid solution at a temperature of about 25° C.

34. The process according to any one of paragraphs 2 to 33, wherein the void is the wellbore.

35. The process according to any one of paragraphs 2 to 33, wherein the void is located within a subterranean formation.

36. The process according to any one of paragraphs 2 to 33, wherein the void is a fluid passage located in a downhole tool.

37. The process according to any one of paragraphs 2 to 33, wherein the void is a fluid passage located in a sand screen, a choke, or a valve.

38. The process according to any one of paragraphs 2 to 33, wherein the void is an annular cavity between a pair of co-axial well tubulars.

39. An alloy, comprising: greater than 50 wt % to less than 65 wt % bismuth; greater than 35 wt % to less than 50 wt % tin; about 0.01 wt % to about 2.5 wt % indium, and less than 1 wt % of lead, wherein all weight percent values are based on a total weight of the alloy.

40. A process for sealing a void in a downhole environment, comprising: introducing an alloy into a wellbore, wherein the alloy comprises greater than 50 wt % to less than 65 wt % bismuth; greater than 35 wt % to less than 50 wt % tin; about 0.01 wt % to about 2.5 wt % indium, and less than 1 wt % of lead, wherein all weight percent values are based on a total weight of the alloy; melting the alloy to produce a liquid alloy; flowing the liquid alloy into a void; and solidifying the liquid alloy to produce a sealed void 41. The alloy or process according to paragraph 39 or 40, wherein the alloy comprises about 0.1 wt % to less than 2 wt % indium, based on the total weight of the alloy.

42. The alloy or process according to any one of paragraphs 39 to 41, wherein the alloy is free of lead.

43. The alloy or process according to any one of paragraphs 39 to 42, further comprising at least one of: about 0.1 wt % to about 3 wt % antimony, about 0.1 wt % to about 0.5 wt % gallium, about 0.1 wt % to about 4 wt % zinc, about 0.1 wt % to about 2.5 wt % chromium, about 0.1 wt % to about 3 wt % copper, and about 0.1 wt % to about 1 wt % nickel, wherein all weight percent values are based on the total weight of the alloy.

44. The alloy according to any one of paragraphs 39 to 42, further comprising about 0.1 wt % to about 0.5 wt % gallium, about 0.1 wt % to about 4 wt % zinc, and about 0.1 wt % to about 2.5 wt % chromium, wherein all weight percent values are based on the total weight of the alloy.

45. The alloy according to any one of paragraphs 39 to 42, further comprising about 0.1 wt % to about 3 wt % antimony, about 0.1 wt % to about 0.5 wt % gallium, about 0.1 wt % to about 4 wt % zinc, and about 0.1 wt % to about 2.5 wt % chromium, wherein all weight percent values are based on the total weight of the alloy.

46. The alloy or process according to any one of paragraphs 39 to 45, wherein the alloy has an average wetting angle on mica of less than 150°, as measured according to ASTM D7334-08 (2013).

47. The alloy or process according to any one of paragraphs 39 to 46, wherein the alloy has an average wetting angle on silicate of less than 142°, as measured according to ASTM D7334-08 (2013).

48. The alloy or process according to any one of paragraphs 39 to 47, wherein the alloy has an average wetting angle on mica of less than 143°, as measured according to ASTM D7334-08 (2013).

49. The alloy or process according to any one of paragraphs 39 to 48, wherein the alloy has an average wetting angle on silicate of less than 139°, as measured according to ASTM D7334-08 (2013).

50. The alloy or process according to any one of paragraphs 39 to 49, wherein the alloy has a melting point of about 115° C. to about 137° C., as measured according to ASTM E794-06(2012).

51. The alloy or process according to any one of paragraphs 39 to 49, wherein the alloy has a melting point of about 115° C. to about 130° C., as measured according to ASTM E794-06(2012).

52. The alloy or process according to any one of paragraphs 39 to 49, wherein the alloy has a melting point of about 115° C. to about 127° C., as measured according to ASTM E794-06(2012).

53. The alloy or process according to any one of paragraphs 39 to 49, wherein the alloy has a melting point of about 115° C. to less than 137° C., as measured according to ASTM E794-06(2012).

54. The alloy or process according to any one of paragraphs 39 to 49, wherein the alloy has a melting point of about 115° C. to less than 127° C., as measured according to ASTM E794-06(2012).

55. The alloy or process according to any one of paragraphs 39 to 49, wherein the alloy has a Vickers Hardness number of greater than 16, as measured according to ASTM E384-17 with a 50 gram indentation load applied for 60 seconds.

56. The alloy or process according to any one of paragraphs 39 to 55, wherein the alloy has a Vickers hardness number of greater than 20, as measured according to ASTM E384-17 with a 50 gram indentation load applied for 60 seconds.

57. The alloy or process according to any one of paragraphs 39 to 55, wherein the alloy has a Vickers hardness number of greater than 16 to about 32, as measured according to ASTM E384-17 with a 50 gram indentation load applied for 60 seconds.

58. The alloy or process according to any one of paragraphs 39 to 55, wherein the alloy has a Vickers hardness number of greater than 20.5 to about 32, as measured according to ASTM E384-17 with a 50 gram indentation load applied for 60 seconds.

59. The alloy or process according to any one of paragraphs 39 to 55, wherein the alloy has a Vickers hardness number of greater than 21 to about 32, as measured according to ASTM E384-17 with a 50 gram indentation load applied for 60 seconds.

60. The alloy or process according to any one of paragraphs 39 to 59, wherein the alloy has a latent heat of fusion of greater than 45 J/g, as measured according to ASTM E793-06(2012).

61. The alloy or process according to any one of paragraphs 39 to 59, wherein the alloy has a latent heat of fusion of about 42 J/g to about 55 J/g, as measured according to ASTM E793-06(2012).

62. The alloy or process according to any one of paragraphs 39 to 59, wherein the alloy has a latent heat of fusion of greater than 47 J/g to about 55 J/g, as measured according to ASTM E793-06(2012).

63. The alloy or process according to any one of paragraphs 39 to 59, wherein the alloy has a latent heat of fusion of greater than 43 J/g to about 55 J/g, as measured according to ASTM E793-06(2012).

64. The alloy or process according to any one of paragraphs 39 to 59, wherein the alloy has a latent heat of fusion of greater than 45 J/g to about 55 J/g, as measured according to ASTM E793-06(2012).

65. The alloy or process according to any one of paragraphs 39 to 64, wherein a weight of an alloy sample decreases by less than 20 wt % per day when the alloy sample is in contact with a 28% hydrochloric acid solution at a temperature of about 25° C.

66. The alloy or process according to any one of paragraphs 39 to 64, wherein a weight of an alloy sample decreases by less than 10 wt % per day when the alloy sample is in contact with a 28% hydrochloric acid solution at a temperature of about 25° C.

67. The alloy or process according to any one of paragraphs 39 to 64, wherein a weight of an alloy sample decreases by less than 5 wt % per day when the alloy sample is in contact with a 28% hydrochloric acid solution at a temperature of about 25° C.

68. The alloy or process according to any one of paragraphs 39 to 64, wherein a weight of an alloy sample decreases by less than 1.5 wt % per day when the alloy sample is in contact with a 28% hydrochloric acid solution at a temperature of about 25° C.

69. The alloy or process according to any one of paragraphs 39 to 64, wherein a weight of an alloy sample decreases by less than 1 wt % per day when the alloy sample is in contact with a 28% hydrochloric acid solution at a temperature of about 25° C.

70. The process according to any one of paragraphs 40 to 69, wherein the void is the wellbore.

71. The process according to any one of paragraphs 40 to 69, wherein the void is located within a subterranean formation.

72. The process according to any one of paragraphs 40 to 69, wherein the void is a fluid passage located in a downhole tool.

73. The process according to any one of paragraphs 40 to 69, wherein the void is a fluid passage located in a sand screen, a choke, or a valve.

74. The process according to any one of paragraphs 40 to 69, wherein the void is an annular cavity between a pair of co-axial well tubulars.

75. An elongated element, comprising: an elongated core body and an outer metal layer disposed about the elongated core body, wherein: the metal layer comprises an alloy, the alloy comprises greater than 50 wt % to less than 65 wt % bismuth; greater than 35 wt % to less than 50 wt % tin; about 0.01 wt % to about 2.5 wt % indium; and at least one of: about 0.01 wt % to about 2.5 wt % antimony, about 0.01 wt % to about 0.5 wt % gallium, about 0.01 wt % to about 4 wt % zinc, and about 0.01 wt % to about 2.5 wt % chromium, and all weight percent values are based on a total weight of the alloy.

76. An elongated element, comprising: an elongated core body and an outer metal layer disposed about the elongated core body, wherein: the metal layer comprises an alloy, the alloy comprises greater than 50 wt % to less than 65 wt % bismuth; greater than 35 wt % to less than 50 wt % tin; about 0.01 wt % to about 2.5 wt % indium, and less than 1 wt % of lead, and all weight percent values are based on a total weight of the alloy.

77. The elongated element according to paragraph 75 or 76, wherein the elongated core body comprises a metal wire, a fiber optic cable, or a pneumatic hose.

78. A seal disposed between a first body and a second body, the seal comprising an alloy, wherein the alloy comprises greater than 50 wt % to less than 65 wt % bismuth; greater than 35 wt % to less than 50 wt % tin; about 0.01 wt % to about 2.5 wt % indium; and at least one of: about 0.01 wt % to about 2.5 wt % antimony, about 0.01 wt % to about 0.5 wt % gallium, about 0.01 wt % to about 4 wt % zinc, and about 0.01 wt % to about 2.5 wt % chromium, and wherein all weight percent values are based on a total weight of the alloy.

79. A seal disposed between a first body and a second body, the seal comprising an alloy, wherein the alloy comprises greater than 50 wt % to less than 65 wt % bismuth; greater than 35 wt % to less than 50 wt % tin; about 0.01 wt % to about 2.5 wt % indium, and less than 1 wt % of lead, and wherein all weight percent values are based on a total weight of the alloy.

80. The seal according to paragraph 78 or 79, wherein the first body comprises a metal and the second body comprises a ceramic.

81. The seal according to paragraph 78 or 79, wherein the first body comprises a first metal and the second body comprises a second metal, and wherein a composition of the first metal is the same or different as a composition of the second metal.

82. The seal according to paragraph 78 or 79, wherein the first body comprises a first ceramic and the second body comprises a second ceramic, and wherein a composition of the first ceramic is the same or different as a composition of the second ceramic.

83. An anti-galling coating disposed on a surface of a body, wherein the anti-galling coating comprises an alloy, wherein the alloy comprises greater than 50 wt % to less than 65 wt % bismuth; greater than 35 wt % to less than 50 wt % tin; about 0.01 wt % to about 2.5 wt % indium; and at least one of: about 0.01 wt % to about 2.5 wt % antimony, about 0.01 wt % to about 0.5 wt % gallium, about 0.01 wt % to about 4 wt % zinc, and about 0.01 wt % to about 2.5 wt % chromium, and wherein all weight percent values are based on a total weight of the alloy.

84. An anti-galling coating disposed on a surface of a body, wherein the anti-galling coating comprises an alloy, wherein the alloy comprises greater than 50 wt % to less than 65 wt % bismuth; greater than 35 wt % to less than 50 wt % tin; about 0.01 wt % to about 2.5 wt % indium, and less than 1 wt % of lead, and wherein all weight percent values are based on a total weight of the alloy.

85. The anti-galling coating according to paragraph 83 or 84, wherein the body comprises a downhole tool.

Although the preceding description has been described herein with reference to particular means, materials, and embodiments, it is not intended to be limited to the particulars disclosed herein; rather, it extends to all functionally equivalent structures, processes, and uses, such as are within the scope of the appended claims.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value. As used herein the terms "about" and "approximately" are used interchangeably, and refer to any experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. An alloy, comprising:

greater than 50 wt % to less than 65 wt % of bismuth;

greater than 35 wt % to less than 50 wt % of tin;

about 0.01 wt % to about 2.5 wt % of indium;

about 0.1 wt % to about 0.5 wt % of gallium;

about 0.1 wt % to about 4 wt % of zinc; and about 0.1 wt % to about 2.5 wt % of chromium, wherein all weight percent values are based on a total weight of the alloy, and wherein the alloy is free of antimony and free of nickel.

2. The alloy of claim 1, further comprising about 0.01 wt % to about 3 wt % of copper, based on the total weight of the alloy.

3. The alloy of claim 1, wherein the alloy is a near-eutectic composition having an initial melting point temperature and a final melting point temperature that is less than 5° C. away from the initial melting point temperature, as measured according to ASTM E794-06(2012).

4. The alloy of claim 1, wherein the alloy is a eutectic composition having a single melting point temperature of about 115° C. to about 137° C., as measured according to ASTM E794-06(2012).

5. The alloy of claim 1, wherein the alloy comprises about 1.5 wt % to about 6.5 wt % of a combined amount of any gallium, any zinc, and any chromium, based on the total weight of the alloy.

6. The alloy of claim 1, wherein the alloy comprises about 0.1 wt % to about 2 wt % of zinc and about 0.1 wt % to about 1.5 wt % of chromium, based on the total weight of the alloy.

7. The alloy of claim 1, wherein the alloy comprises at least 90 wt % of a combined amount of bismuth and tin, based on the total weight of the alloy.

8. The alloy of claim 1, wherein the alloy comprises greater than 53 wt % to less than 57 wt % of bismuth and greater than 37 wt % to less than 43 wt % of tin, based on the total weight of the alloy.

9. The alloy of claim 1, wherein the alloy comprises at least 54 wt % of bismuth and at least 38 wt % of tin, based on the total weight of the alloy.

10. The alloy of claim 1, wherein the alloy comprises at least 55 wt % of bismuth and at least 39 wt % of tin, based on the total weight of the alloy.

11. The alloy of claim 1, further comprising:

less than 1 wt % of lead, wherein all weight percent values are based on the total weight of the alloy.

12. The alloy of claim 11, further comprising:

about 0.1 wt % to about 3 wt % of copper, wherein all weight percent values are based on the total weight of the alloy.

13. The alloy of claim 11, wherein the alloy is free of lead.

14. The alloy of claim 11, wherein the alloy comprises at least 54 wt % of bismuth and at least 38 wt % of tin, based on the total weight of the alloy.

15. An apparatus formed from an alloy comprising greater than 50 wt % to less than 65 wt % of bismuth; greater than 35 wt % to less than 50 wt % of tin; about 0.01 wt % to about 2.5 wt % of indium, about 0.1 wt % to about 0.5 wt % of gallium, about 0.1 wt % to about 4 wt % of zinc, about 0.1 wt % to about 2.5 wt % of chromium, and less than 1 wt % of lead, wherein all weight percent values are based on a total weight of the alloy, wherein the alloy is free of antimony and free of nickel, and wherein the apparatus comprises a well abandonment plug, an annular seal plug, a temporary reversible plug, a packer, or a linger hanger seal.

16. The apparatus of claim 15, wherein the alloy further comprises:

about 0.1 wt % to about 3 wt % of copper, wherein all weight percent values are based on the total weight of the alloy.

* * * * *